US011346267B2

(12) United States Patent
Zhang

(10) Patent No.: US 11,346,267 B2
(45) Date of Patent: May 31, 2022

(54) OPERATING AN EXHAUST GAS AFTERTREATMENT SYSTEM OF AN INTERNAL COMBUSTION ENGINE AND AN EXHAUST GAS AFTERTREATMENT SYSTEM

(71) Applicant: Vitesco Technologies GmbH, Hannover (DE)

(72) Inventor: Hong Zhang, Munich (DE)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 16/767,828

(22) PCT Filed: Nov. 23, 2018

(86) PCT No.: PCT/EP2018/082357
§ 371 (c)(1),
(2) Date: May 28, 2020

(87) PCT Pub. No.: WO2019/105859
PCT Pub. Date: Jun. 6, 2019

(65) Prior Publication Data

US 2020/0378288 A1 Dec. 3, 2020

(30) Foreign Application Priority Data

Nov. 29, 2017 (DE) ..... 10 2017 221 358.2
Sep. 13, 2018 (DE) ..... 10 2018 215 627.1

(51) Int. Cl.
*F01N 3/20* (2006.01)
*F01N 9/00* (2006.01)
(Continued)

(52) U.S. Cl.
CPC ..... *F01N 3/208* (2013.01); *F01N 9/00* (2013.01); *F01N 11/00* (2013.01); *F01N 3/021* (2013.01);
(Continued)

(58) Field of Classification Search
CPC . F01N 3/208; F01N 11/00; F01N 9/00; F01N 2900/1616; F01N 2560/021;
(Continued)

(56) References Cited

U.S. PATENT DOCUMENTS 8,573,043 B2 * 11/2013 Bastoreala ..... F01N 3/208 73/114.75
2011/0296905 A1 * 12/2011 Bastoreala ..... F01N 3/208 73/114.75
(Continued)

FOREIGN PATENT DOCUMENTS

DE 10 2012 220 151 11/2012 ..... F01N 11/00
DE 10 2013 200 623 1/2013 ..... F01N 11/00
(Continued)

OTHER PUBLICATIONS

Search Report for International Application No. PCT/EP2018/082357, 15 pages, dated Jan. 25, 2019.
(Continued)

*Primary Examiner* — Brandon D Lee
(74) *Attorney, Agent, or Firm* — Slayden Grubert Beard PLLC

(57) ABSTRACT

Methods and/or systems for operating an exhaust-gas aftertreatment system of an internal combustion engine include: setting the internal combustion engine to a diagnostic operating mode with relevant diagnostic operating parameters of the internal combustion engine are set to correspond with diagnostic default values; inducing a targeted, defined $NH_3$ and/or $NO_X$ concentration change upstream of the filter;
(Continued)

measuring the $NH_3$ and/or $NO_X$ concentration change downstream of the filter; providing a correlating concentration comparison value; evaluating the concentration change on the basis of the respective concentration comparison value and predefined limit values; and diagnosing the SCR particle filter as defective if the evaluation yields that the concentration comparison value has overshot a predefined limit value.

17 Claims, 3 Drawing Sheets

(51) Int. Cl.
*F01N 11/00* (2006.01)
*F01N 3/021* (2006.01)
*F02D 41/14* (2006.01)

(52) U.S. Cl.
CPC .. *F01N 2560/021* (2013.01); *F01N 2560/026* (2013.01); *F01N 2560/14* (2013.01); *F01N 2570/14* (2013.01); *F01N 2610/02* (2013.01); *F01N 2900/1406* (2013.01); *F01N 2900/1602* (2013.01); *F01N 2900/1616* (2013.01); *F02D 2041/1468* (2013.01)

(58) Field of Classification Search
CPC ..... F01N 2570/14; F01N 3/021; F01N 2560/026; F01N 2560/14; F01N 2610/02; F01N 2900/1406; F01N 2900/1602; F01N 2250/02; F01N 2430/00; F01N 2550/02; F01N 2610/146; F01N 2900/0422; F01N 2900/08; F01N 2900/1402; F01N 2900/1622; F01N 2900/1812; F01N 3/035; F01N 13/0097; F02D 2041/1468; F02D 41/00; F02D 41/0055; F02M 26/00; F02M 26/15; Y02A 50/20; Y02T 10/40; Y02T 10/12
See application file for complete search history.

(56) References Cited

U.S. PATENT DOCUMENTS

| | | | | |
|---|---|---|---|---|
| 2012/0285143 | A1* | 11/2012 | Sun | F02D 41/0275 60/274 |
| 2013/0202506 | A1* | 8/2013 | Pfister | B01D 53/9495 423/212 |
| 2015/0113956 | A1* | 4/2015 | Bauer | F01N 3/208 60/274 |
| 2016/0069243 | A1 | 3/2016 | Hegemann | 60/274 |
| 2017/0051654 | A1* | 2/2017 | Gupta | F01N 3/035 |

FOREIGN PATENT DOCUMENTS

| | | | |
|---|---|---|---|
| JP | 2009 156159 | 7/2009 | F01N 3/20 |
| WO | 2007 037730 | 9/2005 | F01N 11/00 |
| WO | 2011 107686 | 3/2010 | B01D 53/94 |
| WO | 2013 147653 | 10/2013 | F01N 11/00 |

OTHER PUBLICATIONS

Search Report for DE Patent Application No. 10 2018 215 627.1, 13 pages, dated Apr. 26, 2019.
Office Action for DE Patent Application No. 10 2017 221 358.2, 9 pages, dated Jul. 23, 2018.
Korean Office Action, Application No. 2021089633378, 19 pages, dated Nov. 15, 2021.

* cited by examiner

OPERATING AN EXHAUST GAS AFTERTREATMENT SYSTEM OF AN INTERNAL COMBUSTION ENGINE AND AN EXHAUST GAS AFTERTREATMENT SYSTEM

CROSS-REFERENCE TO RELATED APPLICATIONS

This application is a U.S. National Stage Application of International Application No. PCT/EP2018/082357 filed Nov. 23, 2018, which designates the United States of America, and claims priority to DE Application No. 10 2018 215 627.1 filed Sep. 13, 2018, and DE Application No. 10 2017 221 358.2 filed Nov. 29, 2017, the contents of which are hereby incorporated by reference in their entirety.

TECHNICAL FIELD

The present disclosure relates to internal combustion engines. Various embodiments of the teachings herein include methods for operating an exhaust-gas aftertreatment system of internal combustion engines, e.g. diesel engines, which exhaust-gas aftertreatment system has a combined SCR particle filter arranged in an exhaust-gas line and has a device for targeted, defined variation of the $NH_3$ and/or $NO_X$ concentration in the exhaust-gas mass flow upstream of the SCR particle filter.

BACKGROUND

In particular vehicles with diesel internal combustion engines (diesel engine), but increasingly also vehicles with Otto-cycle internal combustion engines (gasoline engine), nowadays there may be a particle filter (DPF, PF) for the purposes of avoiding particles (soot, fine dust) in the exhaust-gas emissions and also a so-called SCR catalytic converter (catalytic converter with selective reduction) for the purposes of reducing the $NO_X$ fraction in the exhaust-gas emissions. In some examples, a combined filter catalytic converter, hereinafter referred to as SCR particle filter or denoted by the abbreviation SC-PF, is a particle filter with SCR function, that is to say a particle filter which has an additional coating composed of an $NO_X/NH_3$ conversion material. In other words, it is therefore a particle filter with an integrated SCR function.

In the case of an SCR catalytic converter, $NH_3$ (ammonia) is formed by adding an aqueous urea solution to the exhaust gas, which ammonia reacts with the $NO_X$ in the exhaust gas to form elemental nitrogen ($N_2$) and water. Legislators are continually lowering the emissions limit values for the exhaust gases of vehicles with internal combustion engines (combustion motors) and issuing regulations to monitor their proper functioning. This applies to so-called OBD (on-board diagnosis: ongoing, automatic self-diagnosis during the intended operation of the vehicle) in such vehicles. Nowadays, the SCR particle filter must also be subjected to such a frequent and precise OBD.

Typically, such diagnosis may be performed with regard to the particle emissions by means of a so-called PM sensor (particulate matter sensor, particle sensor). Here, if the PM emissions downstream of the particle filter as measured by means of the particle sensor are higher than a threshold value, the particle filter is diagnosed as faulty. However, a relatively long period of time is required for such diagnosis. Furthermore, the diagnosis is limited to the particle emissions, and the accuracy of the diagnosis is furthermore not good enough to meet the requirements of future, even lower emissions threshold values.

SUMMARY

The teachings of the present disclosure include methods and/or corresponding exhaust-gas aftertreatment systems of an internal combustion engine which permit particularly rapid and precise monitoring of an SCR particle filter with regard to its $NO_X/NH_3$ conversion and particle filtering during the operation of the internal combustion engine. For example, some embodiments include a method for operating an exhaust-gas aftertreatment system of an internal combustion engine, which exhaust-gas aftertreatment system has an exhaust-gas line (1) for conducting an exhaust-gas mass flow (10) and has an SCR particle filter (3) arranged in the exhaust-gas line (1), wherein a device for targeted, defined variation of the $NH_3$ and/or $NO_X$ concentration is arranged in the exhaust-gas mass flow (10) upstream of the SCR particle filter (3), and at least one first concentration sensor (6) is arranged in the exhaust-gas mass flow (10) downstream of the SCR particle filter (3), having the following steps: setting the internal combustion engine to a diagnostic operating mode, wherein certain relevant diagnostic operating parameters (D-BP) of the internal combustion engine are verified for, or set or adjusted to, correspondence with diagnostic default values (D-BP_set); in the presence of the diagnostic operating mode, targeted, defined inducement of an $NH_3$ concentration change and/or of an $NO_X$ concentration change in the exhaust-gas mass flow (10) upstream of the SCR particle filter (3) in relation to the values of the $NH_3$ concentration and/or of the $NO_X$ concentration that are present in the diagnostic operating mode; measuring the $NH_3$ and/or $NO_X$ concentration change in the exhaust-gas mass flow (10) downstream of the SCR particle filter (3) within a specified time window (TW), which directly follows the abovementioned $NH_3$ and/or $NO_X$ concentration change measured upstream of the SCR particle filter (3), by means of the at least one first concentration sensor (6), which outputs a corresponding first concentration measurement signal (110); and providing a correlating concentration comparison value (VgW) at least on the basis of the first concentration measurement signal (110); evaluating the $NH_3$ and/or $NO_X$ concentration change downstream of the SCR particle filter (3) measured within the specified time window (TW) on the basis of the respective concentration comparison value (VgW) and predefined limit values (GW); and diagnosing the SCR particle filter (3) as defective if the evaluation yields that the concentration comparison value (VgW) has overshot at least one predefined limit value (GW).

In some embodiments, the device for targeted, defined inducement of the $NH_3$ and/or $NO_X$ concentration change in the exhaust-gas mass flow (10) upstream of the SCR particle filter (3) has an $NH_3$ feed device (7) for the feed of an $NH_3$ solution (**7*d*) into the exhaust-gas line (1) and/or has a first exhaust-gas recirculation device (2) which branches off from the exhaust-gas line (1) upstream of the SCR particle filter (3) and/or has a further exhaust-gas recirculation device (8) which branches off from the exhaust-gas line (1) downstream of the SCR particle filter (3**).

In some embodiments, the diagnostic operating mode is characterized by at least one of the following diagnostic operating parameters: engine speed (RPM) of the internal combustion engine between 1100 and 1900 revolutions/minute; operating temperature (T-SC-PF) of the SCR particle filter (3) between 250° C. and 350° C.; pressure difference of the exhaust-gas mass flow (ΔP_SCR-PF) across the SCR particle filter (3) of between 3 bar and 7 bar; stored $NH_3$ quantity (SM_SC-PF) in the SCR particle filter (3) lies above a predefined threshold value; added $NH_3$ quantity adjusted to a value which is stoichiometric in relation to the $NO_X$ concentration in the exhaust gas upstream of the SCR particle filter.

In some embodiments, the defined $NO_X$ concentration change upstream of the SCR particle filter (3) consists in an increase or a reduction of the $NO_X$ concentration that is set as a result of a defined reduction or increase of an exhaust-gas recirculation rate of the first exhaust-gas recirculation device (2) and/or of the further exhaust-gas recirculation device (8).

In some embodiments, the defined $NH_3$ concentration change upstream of the SCR particle filter (3) consists in a defined increase or reduction of the $NH_3$ concentration that is set as a result of a defined increase or reduction of the added quantity of the $NH_3$ solution (7*d*) by means of the $NH_3$ feed device (7).

In some embodiments, in the evaluation of the $NO_X$ concentration change and/or $NH_3$ concentration change downstream of the particle filter (3) measured within the specified time window (TW), a respective maximum value or minimum value, attained within the defined time window (TW), of the concentration change and/or a gradient, determined within the defined time window (TW), of the concentration change is used as concentration comparison value (VgW).

In some embodiments, in the course of the $NH_3$ and/or $NO_X$ concentration change, a concentration increase and an immediately subsequent concentration reduction occur, wherein, after the concentration increase for a particular first period of time, the concentration reduction occurs to such a selected value, and for such a selected second period of time, that a resulting mean value of the $NH_3$ and/or $NO_X$ concentration over the duration of the concentration increase and of the concentration reduction corresponds to the value of the $NH_3$ and/or $NO_X$ concentration prevailing before the concentration increase.

In some embodiments, for the measurement of the $NH_3$ and/or $NO_X$ concentration change in the exhaust-gas mass flow (10), use is made in each case of a combined concentration sensor (6) which combines the $NH_3$ and/or $NO_X$ concentration change in a combined concentration measurement signal (110).

In some embodiments, the respective specified time window (TW) has a duration of less than or equal to 5 seconds, in particular less than or equal to 3 seconds.

In some embodiments, after the diagnosis of the SCR particle filter (3), the targeted, defined $NH_3$ and/or $NO_X$ concentration change in the exhaust-gas mass flow (10) upstream of the SCR particle filter (3) is withdrawn and, in a manner dependent on the diagnosis result, the internal combustion engine is transferred back into the normal working operating mode (BP_Norm) and continues to be operated, or is restricted to emergency operation (BP_Not).

In some embodiments, an additional concentration sensor (5) is arranged in the exhaust-gas mass flow (10) upstream of the SCR particle filter (3), by means of which additional concentration sensor a second concentration measurement signal (100) which correlates with the $NH_3$ and/or $NO_X$ concentration change in the exhaust-gas mass flow (10) upstream of the SCR particle filter (3) is provided, wherein the concentration comparison value (VgW) used for the evaluation of the measured $NH_3$ and/or $NO_X$ concentration change downstream of the SCR particle filter (3) is based on the respective $NH_3$ and/or $NO_X$ concentration changes downstream and upstream of the SCR particle filter (3) determined within the defined time window (TW).

In some embodiments, the values of the $NH_3$ and/or $NO_X$ concentration changes determined within the defined time window at a particular point in time, and/or the gradients of said concentration changes, in each case upstream and downstream of the SCR particle filter (3) are compared with one another or set in relation to one another.

In some embodiments, the $NH_3$ and/or $NO_X$ concentration change has a concentration increase and an immediately subsequent concentration reduction, and the values and/or the gradients of the concentration increase and of the concentration reduction in each case upstream and downstream of the SCR particle filter (3) are used in combination with one another for the evaluation of the measured $NH_3$ and/or $NO_X$ concentration change downstream of the SCR particle filter (3).

As another example, some embodiments include an exhaust-gas aftertreatment system of an internal combustion engine, which exhaust-gas aftertreatment system has an SCR particle filter (3) arranged in an exhaust-gas line (1) and has at least one device for targeted, defined variation of the $NH_3$ and/or $NO_X$ concentration in the exhaust-gas mass flow (10) upstream of the SCR particle filter (3) and has at least one first concentration sensor (6) for measuring the $NH_3$ and/or $NO_X$ concentration in the exhaust-gas mass flow (10) downstream of the SCR particle filter (3), characterized in that the exhaust-gas aftertreatment system has an electronic processing and control unit (15) which is configured for targeted, defined variation of the $NH_3$ and/or $NO_X$ concentration in the exhaust-gas mass flow (10) upstream of the SCR particle filter (3) by means of at least one of the devices for targeted, defined variation of the $NH_3$ and/or $NO_X$ concentration and for detecting a first concentration measurement signal (110) output by the at least one concentration sensor (6), wherein the electronic processing and control unit (15) is furthermore configured to execute the method for operating an exhaust-gas aftertreatment system of an internal combustion engine as described above.

In some embodiments, it has an additional concentration sensor (5) which is arranged in the exhaust-gas mass flow (10) upstream of the SCR particle filter (3) and which serves for measuring the $NH_3$ and/or $NO_X$ concentration upstream of the SCR particle filter (3), wherein the electronic processing and control unit (15) is configured to execute the method for operating an exhaust-gas aftertreatment system of an internal combustion engine as claimed in any of claims 11 to 13.

In some embodiments, the device for targeted, defined variation of the $NH_3$ and/or $NO_X$ concentration in the exhaust-gas mass flow (10) upstream of the SCR particle filter (3) has an $NH_3$ feed device (7) for the feed of an $NH_3$ solution (7*d*) into the exhaust-gas line (1) and/or has a first exhaust-gas recirculation device (2) which branches off from the exhaust-gas line (1) upstream of the SCR particle filter (3) and/or has a further exhaust-gas recirculation device (8) which branches off from the exhaust-gas line (1) downstream of the SCR particle filter (3).

In some embodiments, the electronic processing and control unit (15) is an integral constituent part of a central control unit (16) of the internal combustion engine, and the method for being executed is part of an on-board diagnostic system for monitoring the exhaust-gas-relevant functional units of the internal combustion engine during intended operation.

BRIEF DESCRIPTION OF THE DRAWINGS

The teachings herein and exemplary embodiments and developments thereof are discussed in detail below with reference to the figures. In the figures.

Figure 1:
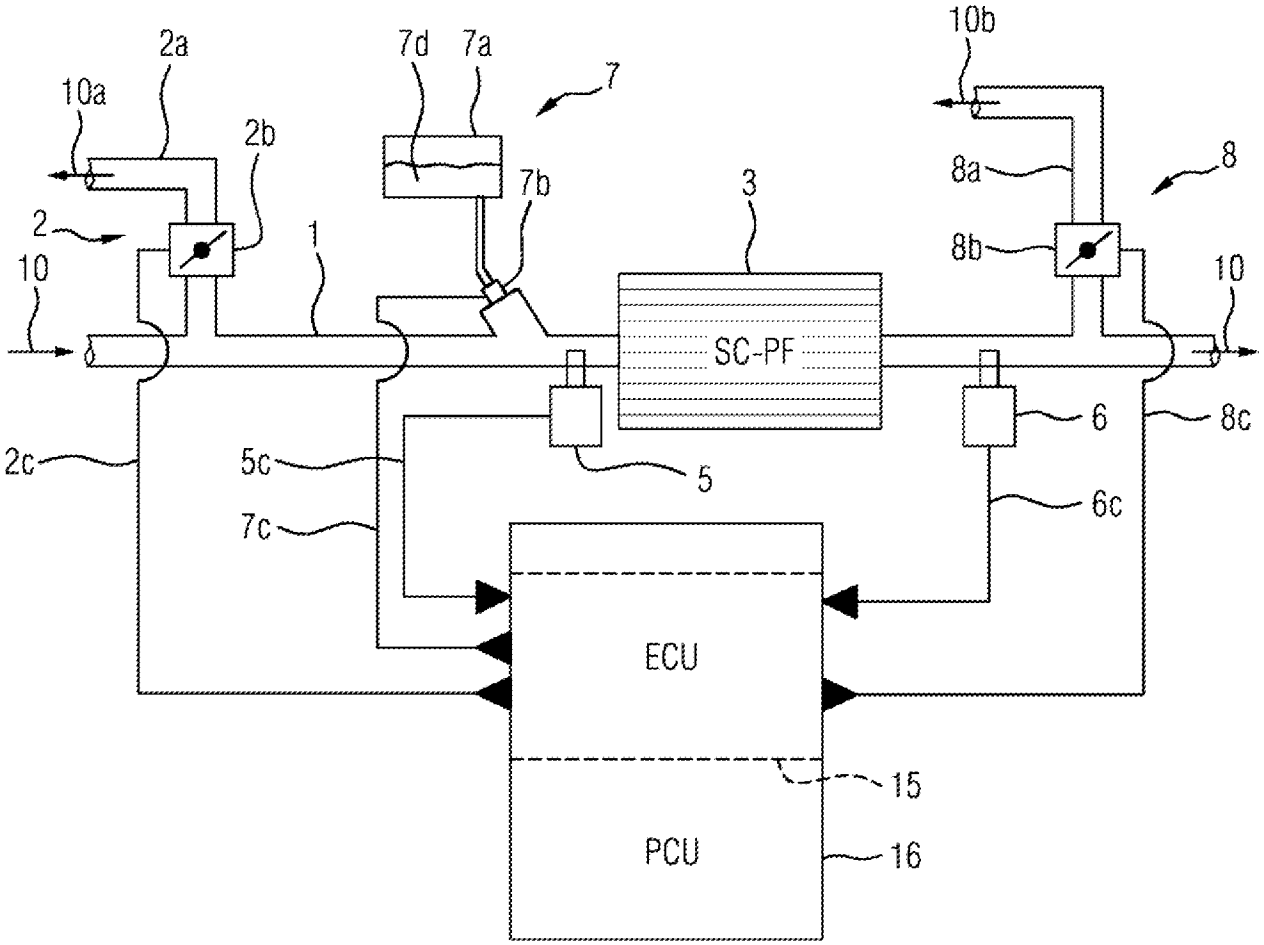
FIG. 1 is a schematic illustration of an example embodiment of an exhaust-gas aftertreatment system incorporating teachings of the present disclosure.

Objects of identical function and designation are denoted by the same reference signs throughout the figures.

DETAILED DESCRIPTION

In some embodiments, an exhaust-gas aftertreatment system of an internal combustion engine includes an exhaust-gas line for conducting an exhaust-gas mass flow and has an SCR particle filter arranged in the exhaust-gas line, and wherein a device for targeted, defined variation of the $NH_3$ and/or $NO_X$ concentration is arranged in the exhaust-gas mass flow upstream of the SCR particle filter, and at least one first concentration sensor is arranged in the exhaust-gas mass flow downstream of the SCR particle filter.

In such an embodiment:

Firstly, the internal combustion engine is set to a diagnostic operating mode, wherein certain relevant diagnostic operating parameters of the internal combustion engine are verified for, or set or adjusted to, correspondence with diagnostic default values.

In the presence of the diagnostic operating mode, a targeted, defined inducement of an $NH_3$ concentration change and/or of an $NO_X$ concentration change in the exhaust-gas mass flow upstream of the SCR particle filter in relation to the values of the $NH_3$ concentration and/or of the $NO_X$ concentration that are present in the diagnostic operating mode is performed.

Subsequently, the measurement of the $NH_3$ and/or $NO_X$ concentration change in the exhaust-gas mass flow downstream of the SCR particle filter within a specified time window, which directly follows the abovementioned $NH_3$ and/or $NO_X$ concentration change measured upstream of the SCR particle filter, is performed by means of the at least one first concentration sensor, which outputs a corresponding first concentration measurement signal, and providing a correlating concentration comparison value at least on the basis of the first concentration measurement signal.

An evaluation of the $NH_3$ and/or $NO_X$ concentration change downstream of the SCR particle filter measured within the specified time window is performed on the basis of the respective concentration comparison value and predefined limit values.

Finally, the SCR particle filter is diagnosed as defective if the evaluation yields that the concentration comparison value has overshot at least one predefined limit value.

In some embodiments, an exhaust-gas aftertreatment system of an internal combustion engine has an SCR particle filter arranged in an exhaust-gas line and has at least one device for targeted, defined variation of the $NH_3$ and/or $NO_X$ concentration in the exhaust-gas mass flow upstream of the SCR particle filter and has at least one concentration sensor for measuring the $NH_3$ and/or $NO_X$ concentration in the exhaust-gas mass flow downstream of the SCR particle filter. Said exhaust-gas aftertreatment system is characterized by the fact that it has an electronic processing and control unit which is configured for targeted, defined variation of the $NH_3$ and/or $NO_X$ concentration in the exhaust-gas mass flow upstream of the SCR particle filter by means of the device for targeted, defined variation of the $NH_3$ and/or $NO_X$ concentration and for detecting a first concentration measurement signal output by the at least one concentration sensor. Here, the electronic processing and control unit is furthermore configured to execute the method for operating an exhaust-gas aftertreatment system of an internal combustion engine according to any of the embodiments of the methods described above and below.

In some embodiments, a method includes using an $NO_X$ and/or $NH_3$ sensor downstream of an SCR particle filter in order, in conjunction with an $NH_3$ concentration change and/or an $NO_X$ concentration change in the exhaust-gas mass flow upstream of the SCR particle filter, to subject the SCR particle filter to a functional check, in particular a performance diagnosis. As an SCR particle filter, use is made, for example, of a wall-flow filter with suitable SCR coating. Function-influencing damage to SCR particle filters generally consists in apertures or holes in the substrate of the filter, the number or cross-sectional area of which determines the degree of damage and through which a corresponding fraction of the exhaust gas can pass without being filtered and without being treated. If the overall cross section of the apertures or open holes is above a threshold value, the corresponding particle emissions overshoot a diagnosis threshold value (OBD threshold value).

In order to detect this state in a constant or steady operating state, for example at idle, in the case of a quasi-constant SCR particle filter temperature at which the $NO_X$ concentration signal and/or the $NH_3$ concentration signal downstream of the SCR particle filter varies to a small extent, for example less than 1 ppm/sec, the added quantity of the urea solution and/or the $NO_X$ untreated emission is increased preferably in one step, for example by 200 ppm $NH_3$/$NO_X$ proceeding from the previously present $NH_3$ added quantity or $NO_X$ untreated emission, and the $NO_X$ and/or $NH_3$ signal course is observed (measurement of the corresponding concentration increase). If the SCR particle filter now lies within the emissions limit, it can be assumed that the total cross section of apertures in the filter substrate is so small that the added urea or the increased $NO_x$ concentration is initially for the most part stored in the SCR particle filter. Therefore, the $NO_x$ or $NH_3$ signal measured downstream of the filter has only a slight increase over a short period of time of, for example, 3 seconds, in a manner dependent on the air mass flow. The corresponding signal is thereafter stable and has a much lower gradient (less than 1 ppm/sec) than an excessively damaged SCR particle filter.

However, if the threshold value is overshot, the total cross section of apertures in the filter substrate is so large that a major part of the added urea or the increased $NO_x$ concentration flows through the SCR particle filter virtually without being decelerated and without being treated, such that, within the specified, immediately subsequent time window, the corresponding sensors downstream of the SCR particle filter register a direct, elevated $NH_3/NO_X$ concentration increase, following which the corresponding signal returns to a more stable state with a lower gradient.

It has been found that the ratio between the $NO_x$ and/or $NH_3$ concentration change downstream of the SCR particle filter and the $NO_x$ and/or $NH_3$ concentration change upstream of the SCR particle filter is directly proportional to the total cross section of the apertures in the filter substrate of the SCR particle filter. If this ratio is above a certain threshold value or limit value, the filter is classed as defective with regard to particle conversion.

A corresponding $NO_x$ concentration change upstream of the SCR particle filter can be carried out, for example, by reducing the exhaust-gas recirculation rate (EGR rate), in particular in the case of high-pressure exhaust-gas recirculation but also in the case of low-pressure exhaust-gas recirculation. Here, too, it can be seen that the $NO_x$ concentration change downstream of the SCR particle filter in relation to the $NO_x$ concentration change upstream of the SCR particle filter is directly proportional to the total cross section of the apertures in the filter substrate of the SCR particle filter.

In some embodiments, a concentration comparison value is determined on the basis of the concentration measurement signal provided by means of the at least one concentration sensor. In its simplest form, this concentration comparison value may for example represent the maximum deflection of the concentration measurement signal within the specified time window. The concentration comparison value may however also be a ratio between the $NH_3$ and/or $NO_x$ concentration change upstream and downstream of the SCR particle filter. Likewise, the concentration comparison value may be determined on the basis of several successive concentration changes, and the respective gradients of the concentration changes may also be taken into consideration, as will be explained in more detail further below. Here, the concentration change may be understood to mean both a concentration increase and a concentration reduction, or both in succession.

The concentration sensor referred to may be an $NH_3$ sensor or an $NO_X$ sensor, depending on whether the $NH_3$ or $NO_X$ concentration is changed for the purposes of executing the method. While an $NH_3$ sensor is only suitable for measuring the $NH_3$ concentration, the aforementioned $NO_x$ sensor, on the other hand, can measure both the $NH_3$ and the $NO_x$ concentration and consequently also a combination of $NO_x$ and $NH_3$. In this case it is thus a combined $NH_3/NO_X$ concentration sensor. Depending on the desired measurement, the appropriate sensors can therefore be provided.

In some embodiments, an exhaust-gas aftertreatment system of an internal combustion engine, in particular of a diesel engine, comprises an SCR particle filter arranged in an exhaust-gas line and has at least one device for targeted, defined variation of the $NH_3$ and/or $NO_X$ concentration in the exhaust-gas mass flow upstream of the SCR particle filter and has at least one first concentration sensor for measuring the $NH_3$ and/or $NO_X$ concentration in the exhaust-gas mass flow downstream of the SCR particle filter. Here, said exhaust-gas aftertreatment system is characterized by the fact that it has an electronic processing and control unit which is configured for targeted, defined variation of the $NH_3$ and/or $NO_X$ concentration in the exhaust-gas mass flow upstream of the SCR particle filter by means of the device for targeted, defined variation of the $NH_3$ and/or $NO_X$ concentration and for detecting a first concentration measurement signal output by the at least one first concentration sensor. In some embodiments, the electronic processing and control unit is furthermore configured to execute a method for operating an exhaust-gas aftertreatment system of an internal combustion engine as presented in the embodiments above and in the embodiments described below.

FIG. 1 schematically shows, in a simplified illustration, an embodiment of an exhaust-gas aftertreatment system according to the invention of an internal combustion engine, for example of a diesel engine. The exhaust-gas mass flow 10 passing from the internal combustion engine (not illustrated here) is conducted in the direction of the arrows through an exhaust-gas line 1, and in the process passes through an SCR particle filter 3 (SC-PF), which is designed for example as a wall-flow filter with SCR coating and is arranged in the exhaust-gas line 1.

For targeted, defined inducement of an $NH_3$ concentration change in the exhaust-gas mass flow 10 upstream of the SCR particle filter 3, an $NH_3$ feed device 7 is arranged on the exhaust-gas line 1 upstream of the SCR particle filter 3 for the purposes of feeding an $NH_3$ solution **7*d* into the exhaust-gas line 1. In this exemplary embodiment, the $NH_3$ feed device 7 has a reservoir 7*a* for storing a suitable aqueous $NH_3$ solution 7*d*, which is also referred to as urea solution. The reservoir 7*a* is connected via a feed line to a dosing device 7*b*, for example an injection valve, which in turn is arranged on the exhaust-gas line 1 and is designed to release defined quantities of the $NH_3$ solution into the exhaust-gas mass flow 10**. The $NH_3$ solution that is fed in produces $NH_3$, which converts the $NO_x$ fraction contained in the exhaust gas into nitrogen and water. The SCR particle filter therefore performs its function as a diesel particle filter and at the same time causes a reduction of the $NO_x$ fraction in the exhaust gas.

Furthermore, for targeted, defined inducement of an $NO_x$ concentration change in the exhaust-gas mass flow 10 upstream of the SCR particle filter 3, an exhaust-gas recirculation device 2 which branches off from the exhaust-gas line 1 upstream of the SCR particle filter 3, a so-called high-pressure exhaust-gas recirculation system, is provided, via which a first partial exhaust-gas mass flow **10*a* of the exhaust-gas mass flow 10 emitted by the internal combustion engine is recirculated into the intake region of the internal combustion engine via a first exhaust-gas recirculation line 2*a*. The magnitude of the recirculated first partial exhaust-gas mass flow 10*a* can be set by means of a first exhaust-gas recirculation valve 2*b* arranged in the first exhaust-gas recirculation line 2*a*. The branching point of this exhaust-gas recirculation device 2 is expediently arranged on the exhaust-gas line 1 upstream of the $NH_3$ feed device 7, because the $NH_3$ solution 7*d* that is fed is to be fed in its entirety to the SCR particle filter 3** for the $NO_x$ reduction.

In some embodiments, as illustrated in FIG. 1, for targeted, defined inducement of an $NO_x$ concentration change in the exhaust-gas mass flow 10 upstream of the SCR particle filter 3, an exhaust-gas recirculation device 8 which branches off from the exhaust-gas line 1 downstream of the SCR particle filter 3, a so-called low-pressure exhaust-gas recirculation system, is provided, via which a further partial exhaust-gas mass flow **10*b* of the exhaust-gas mass flow 10 emitted by the internal combustion engine is recirculated into the intake region of the internal combustion engine via a further exhaust-gas recirculation line 8*a*. The magnitude of the recirculated further partial exhaust-gas mass flow 10*b* can be set in this case by means of a further exhaust-gas recirculation valve 8*b* arranged in the further exhaust-gas recirculation line 8*a***.

The functioning of such exhaust-gas recirculation devices for reducing emissions, in particular for influencing the untreated $NO_x$ emissions of the internal combustion engine, that is to say the $NO_x$ concentration in the exhaust gas, is known to the person skilled in the art from the prior art and will not be explained further here.

Although the embodiment shown in FIG. 1 has both an $NH_3$ feed device 7 and a first exhaust-gas recirculation device 2 and a further exhaust-gas recirculation device 8, the presence of just one of these devices may be sufficient. It is likewise also possible for two or all three of these devices to be used in combined operation and to be combined, as it were, into one device for targeted, defined inducement of an $NH_3$ concentration change and/or an $NO_x$ concentration change in the exhaust-gas mass flow 10 upstream of the SCR particle filter 3.

In some embodiments, at least a first concentration sensor 6 is arranged in the exhaust-gas mass flow 10 for the purposes of measuring the $NH_3$ and/or $NO_x$ concentration in the exhaust-gas mass flow 10 downstream of the SCR particle filter 3. This first concentration sensor 6 outputs a corresponding first concentration measurement signal 110, on the basis of which a correlating concentration comparison value (VgW) can be provided.

In some embodiments, there is an additional concentration sensor 5 arranged in the exhaust-gas mass flow 10 upstream of the SCR particle filter 3 for the purposes of measuring the $NH_3$ and/or $NO_x$ concentration upstream of the SCR particle filter 3. Said additional concentration sensor is expediently arranged in the exhaust-gas mass flow 10 downstream of the $NH_3$ feed device 7 and the branching point of the first exhaust-gas recirculation device 2 and directly upstream of the SCR particle filter 3, such that, with this additional concentration sensor 5, both the $NH_3$ and the $NO_X$ concentration change upstream of the SCR particle filter 3, that is to say the targetedly induced $NH_3$ and/or $NO_X$ concentration change, can be detected. This additional concentration sensor 5 also outputs a corresponding second concentration measurement signal 100, which can be used for providing a concentration comparison value (VgW).

In some embodiments, an actually measured value for the $NH_3$ concentration change and/or the $NO_X$ concentration change in the exhaust-gas mass flow 10 upstream of the SCR particle filter 3 can be used, for example, for providing a concentration comparison value (VgW), which increases the reliability of the diagnosis of the SCR particle filter. Otherwise, if only the concentration sensor 6 arranged downstream of the SCR particle filter 3 is available, it is for example the case that the default value for the targeted, defined concentration change is adopted as an actual value, wherein it is assumed that the device for the targeted, defined change of the respective concentration value is functioning without errors.

In some embodiments, as illustrated in FIG. 1, there is an electronic processing and control unit 15 (ECU). This is configured for targeted, defined variation of the $NH_3$ and/or $NO_x$ concentration in the exhaust-gas mass flow 10 upstream of the SCR particle filter 3, by means of at least one of the abovementioned devices for targeted, defined variation of the $NH_3$ and/or $NO_x$ concentration, and for detection of a first concentration measurement signal (110) output by the at least one concentration sensor 6 and of a second concentration measurement signal. For this purpose, the electronic processing and control unit 15 is electrically connected via signal lines 2*c*, 5*c*, 6*c*, 7*c* and 8*c* to the system components first exhaust-gas recirculation valve 2*b*, additional concentration sensor 5, first concentration sensor 6, dosing device 7*b* and further exhaust-gas recirculation valve 8*b* in order to transmit control signals to the corresponding system components or receive signals, in particular measurement signals, from the corresponding system components.

The electronic processing and control unit 15 is furthermore configured to execute the methods described herein for operating an exhaust-gas aftertreatment system of an internal combustion engine according to any of the embodiments on the basis of a first concentration measurement signal of the first concentration sensor 6 or on the basis of the two concentration measurement signals of the first and of the additional concentration sensor 6, 5. For this purpose, the sequence of the method, corresponding calculation algorithms, and the required default values for the control of the exhaust-gas aftertreatment system and of the internal combustion engine are stored in the form of executable program code in the electronic control unit 15 or in assigned electronic memory units.

In some embodiments, the electronic processing and control unit 15 is an integral constituent part of a central control unit (CPU) 16 of the internal combustion engine, wherein the method for being executed is part of an on-board diagnostic system for monitoring the exhaust-gas-relevant functional units of the internal combustion engine during intended operation.

Figure 2:
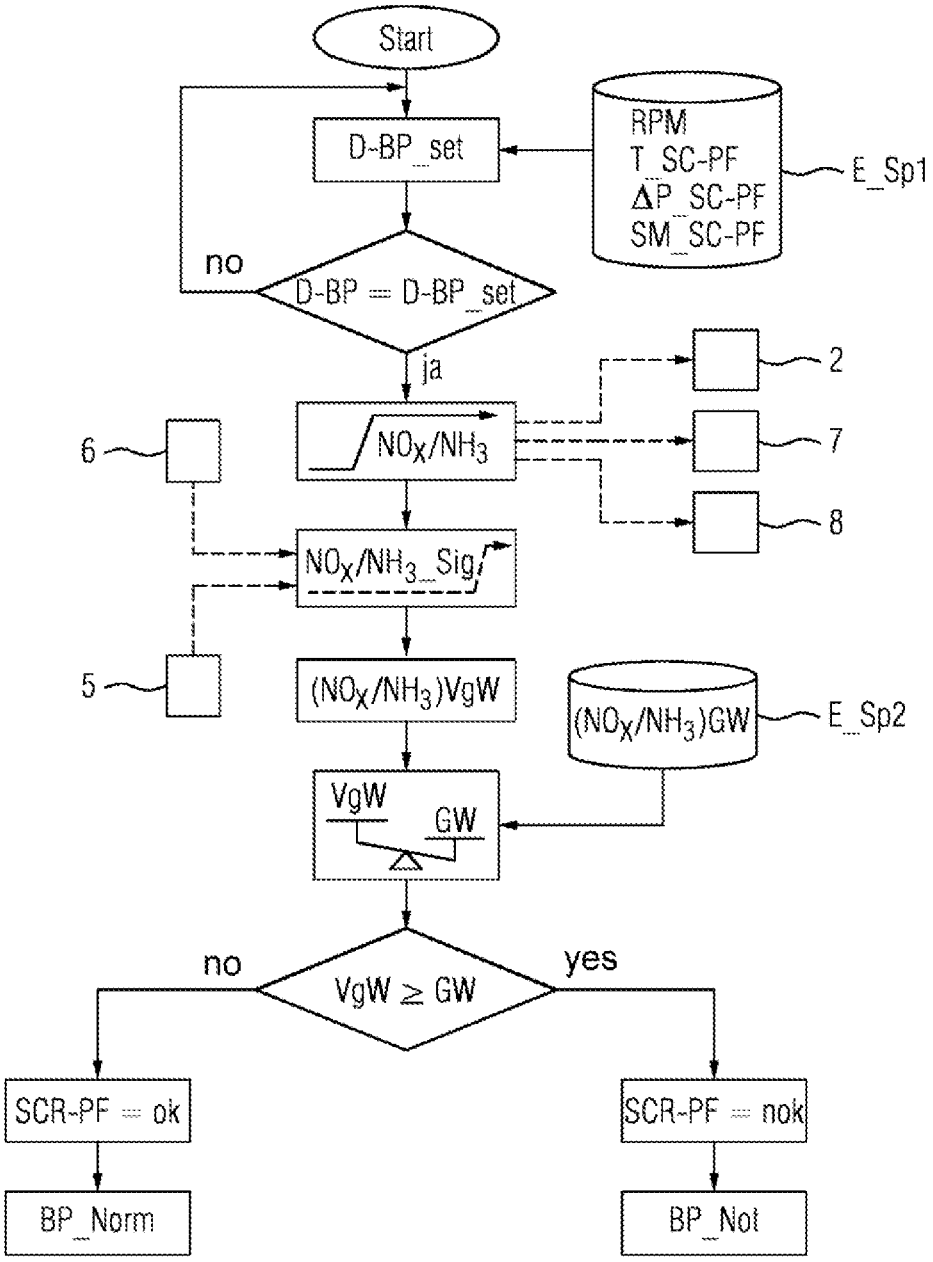
FIG. 2 is a block diagram for illustrating an example method sequence incorporating teachings of the present disclosure.

An example method for operating an exhaust-gas aftertreatment system of an internal combustion engine in one of the embodiments described above is illustrated, in the main method steps, on the basis of the simplified block sequence program illustrated in FIG. 2. After the start of the method, the internal combustion engine is set to a diagnostic operating mode in the first method step identified by "D-BP_set", wherein certain relevant diagnostic operating parameters (D-BP) of the internal combustion engine are verified for, or set or adjusted to, correspondence with diagnostic default values (D-BP_set).

In some embodiments, the diagnostic operating mode is characterized by at least one of the following diagnostic operating parameters:

- The engine speed (RPM) of the internal combustion engine is adjusted to a value between 1100 and 1900 revolutions/minute.
- The operating temperature (T-SC-PF) of the SCR particle filter 3 is adjusted to a value between 250° C. and 350° C.
- A pressure difference of the exhaust-gas mass flow (ΔP_SCR-PF) across the SCR particle filter 3 of between 3 bar and 7 bar is verified.
- It is furthermore verified that a stored $NH_3$ quantity (SM_SC-PF) in the SCR particle filter 3 lies above a predefined threshold value.
- It is additionally possible for the added $NH_3$ quantity to be adjusted to a value which is stoichiometric in relation to the $NO_X$ concentration in the exhaust gas upstream of the SCR particle filter, that is to say that the added $NH_3$ quantity corresponds to a quantity that is required for the complete conversion of the $NO_X$ fraction in the exhaust gas in the SCR particle filter. The specification of these operating parameters ensures stable operation of the internal combustion engine, reduces disturbance influences on the method and thus increases the reliability of the validity of the diagnosis of the SCR particle filter.

For this purpose, the corresponding diagnostic default values are stored in an electronic memory of the electronic processing and control unit (ECU), which is denoted by "E_Sp1" in FIG. 2, and can be read out and used in a simple manner for the execution of this method step. Since the adjustment, setting and verification of the diagnostic operating parameters can take a certain amount of time, it is checked in the following method step, which is denoted by "D-BP=D-BP_set", whether the present diagnostic operating parameters correspond to the diagnostic default values. For as long as this is not the case, an attempt will continue to be made to align the diagnostic operating parameters (D-BP) with the diagnostic default values (D-BP_set). If the desired diagnostic operating parameters are present, the next process step can follow. In the following process step, denoted by "$NO_X/NH_3$", the targeted, defined inducement of an $NH_3$ concentration change and/or of an $NO_X$ concentration change in the exhaust-gas mass flow 10 upstream of the SCR particle filter 3 is then performed. Depending on the particular embodiment of the exhaust-gas aftertreatment system, this is done by corresponding individual or combined control of one or more of the following devices: $NH_3$ feed device 7, first exhaust-gas recirculation device 2 and further exhaust-gas recirculation device 8; as illustrated in FIG. 2 by dashed lines. Depending on the design of the exhaust-gas aftertreatment system, an $NH_3$ concentration change or an $NO_X$ concentration change or also a combined or superposed $NO_X/NH_3$ concentration change can be induced, by means of corresponding control of the above-mentioned devices for targeted, defined inducement of the $NH_3$ and/or $NO_X$ concentration change, by the electronic processing and control unit (ECU) 15.

In some embodiments, the defined $NO_x$ concentration change upstream of the SCR particle filter 3 may consist in an increase or a reduction in the $NO_x$ concentration, which is achieved, for example, by means of a defined reduction or increase of an exhaust-gas recirculation rate, wherein, here, it is also possible in an assisting manner for yet further operating parameters of the internal combustion engine to be influenced in the sense of an increase of the $NO_x$ concentration in the exhaust gas. Here, the exhaust-gas recirculation rate can be set by means of the first exhaust-gas recirculation device 2 or the further exhaust-gas recirculation device 8 or the two exhaust-gas recirculation devices 2, 8 in combination. This is realized, for example, by appropriate control of the first exhaust-gas recirculation valve 2*b* or of the second exhaust-gas recirculation valve 8*b* or a combined control of the first and the second exhaust-gas recirculation valves 2*b*, 8*b* by means of the electronic processing and control unit (ECU) 15.

In some embodiments, the defined $NH_3$ concentration change upstream of the SCR particle filter 3 may consist in a defined increase or reduction of the $NH_3$ concentration that is set as a result of a defined increase or reduction of the added quantity of the $NH_3$ solution 7*d* by means of the $NH_3$ feed device 7. This is realized in particular by corresponding control of the metering device 7*b* by means of the electronic processing and control unit (ECU) 15.

In some embodiments, in the method step denoted "$NO_X/NH_3$_Sig", the $NH_3$ and/or $NO_X$ concentration change in the exhaust-gas mass flow 10 downstream of the SCR particle filter 3 is measured within a specified time window (TW) which directly follows the aforementioned $NH_3$ and/or $NO_x$ concentration change measured upstream of the SCR particle filter 3. This is performed by means of the at least one first concentration sensor 6, which outputs a corresponding first concentration measurement signal 110, which is fed via the signal line 6*c* to the electronic processing and control unit for further processing.

In some embodiments, in the course of the abovementioned method step, the $NH_3$ and/or $NO_x$ concentration change upstream of the SCR particle filter is additionally measured in the same time window (TW). For this purpose, by means of an additional concentration sensor 5 which is arranged in the exhaust-gas mass flow 10 upstream of the SCR particle filter 3, a second concentration measurement signal 120 that correlates with the $NH_3$ and/or $NO_x$ concentration change in the exhaust-gas mass flow 10 upstream of the SCR particle filter 3 is provided, and is fed via a signal line 5*c* to the electronic processing and control unit ECU. This makes possible not only the relative consideration of the concentration change upstream and downstream of the SCR particle filter 3, and an associated increase in the diagnostic certainty of the method, but also the possibility of assessing the function of the exhaust-gas recirculation devices 2, 8 and of the $NH_3$ feed device 7.

In the following process step, denoted by "($NO_X/NH_3$) VGW", a correlating concentration comparison value (VgW) is provided at least on the basis of the first concentration measurement signal (110). For example, in different embodiments of the method, a respective maximum value or minimum value of the concentration change attained within the defined time window (TW), and/or a gradient of the concentration change determined within the defined time window (TW), can be used as the concentration comparison value (VgW).

In some embodiments, provided that the $NH_3$ and/or $NO_x$ concentration change upstream of the SCR particle filter is additionally measured, the concentration comparison value (VgW) can be based on the respective $NH_3$ and/or $NO_x$ concentration changes downstream and upstream of the SCR particle filter 3 determined within the defined time window. For this purpose, it is for example possible, in a further embodiment of the method, for the values of the $NH_3$ and/or $NO_X$ concentration changes determined within the defined time window at a particular point in time, and/or the gradients of said concentration changes, in each case upstream and downstream of the SCR particle filter 3 to be compared with one another or set in relation to one another. This makes it possible to provide a particularly reliable concentration comparison value (VgW) and increases the diagnostic certainty of the method, since incorrect diagnoses owing to possibly defective devices for $NH_3$ and/or $NO_x$ concentration change can be ruled out.

In the following method step, denoted by "VgW-GW", the $NH_3$ and/or $NO_X$ concentration change downstream of the SCR particle filter (3) measured within the specified time window (TW) is evaluated on the basis of the respective concentration comparison value (VgW) and predefined limit values (GW). Here, depending on the execution of the method, as already mentioned above, a respective maximum value or minimum value of the concentration change and/or a determined gradient of the concentration change, or also comparison or ratio values based on the values or gradients of the concentration change respectively measured in each case upstream and downstream of the SCR particle filter 3, can be used as concentration comparison value. This allows wide variance in the configuration of the methods and the adaptation to the requirements in the respective usage situation. Correspondingly adapted limit values must then be specified in accordance with the concentration comparison value used. These may for example be determined beforehand, empirically or by means of model calculation, and are stored for example in an electronic memory area of the electronic processing and control unit and are retrieved from there for the evaluation of the concentration change. Such an electronic memory area is denoted in FIG. 2 by E_Sp2 and contains the corresponding limit values, which are illustrated as "($NO_X/NH_3$)_GW".

On the basis of the above-described evaluation of the concentration change downstream of the SCR particle filter 3, in the following process step, denoted by "VGW≥GW", that the SCR particle filter 3 is diagnosed as defective, "SCR-PF=nok", if the evaluation yields that the concentration comparison value (VgW) has overshot at least one predetermined limit value (GW). Otherwise, the SCR particle filter is diagnosed as functional, "SCR-PF=ok", if the concentration comparison value has not reached or overshot a limit value. The method is thus completed. In order to ensure permanently error-free operation of the exhaust-gas aftertreatment system, the methods may be repeated in certain cycles during operation, wherein these cycles may be based on a certain operating duration, on a certain operating performance or on demand values determined during operation.

In some embodiments, in the course of the $NH_3$ and/or $NO_X$ concentration change, a concentration increase and an immediately subsequent concentration reduction occur. Here, after the concentration increase for a particular first period of time, the concentration reduction occurs to such a selected value, and for such a selected second period of time, that a resulting mean value of the $NH_3$ and/or $NO_X$ concentration downstream of the SCR particle filter over the duration of the concentration increase and of the concentration reduction corresponds to the value of the $NH_3$ and/or $NO_X$ concentration prevailing before the concentration increase. It is thereby ensured that no increase in pollutant emissions caused by the method occurs over the duration of the method, averaged over time.

In some embodiments, for the measurement of the $NH_3$ and/or $NO_X$ concentration change in the exhaust-gas mass flow 10, use is made in each case of a combined concentration sensor 6 which combines the $NH_3$ and/or $NO_X$ concentration change in a combined concentration measurement signal 110. This may apply both to the first concentration sensor 6, downstream of the SCR particle filter 3, and to the second concentration sensor 5, upstream of the SCR particle filter 3. In some embodiments, the method specifies both an $NH_3$ concentration change and an $NO_X$ concentration change and a combined $NH_3/NO_X$ concentration change, and thus also opens up a greater scope for the extent of the predetermined concentration change.

In some embodiments, the respective specified time window (TW) for the measurement of the $NH_3$ and/or $NO_X$ concentration change in the exhaust-gas mass flow 10 downstream and/or upstream of the SCR particle filter 3 has a duration of less than or equal to 5 seconds, in particular less than or equal to 3 seconds. The length of this time window ensures that only a rapid $NH_3$ and/or $NO_x$ concentration change downstream of the SCR particle filter 3, such as occurs only if the SCR particle filter 3 is defective, has an effect in the determination of the concentration comparison value and thus in the diagnosis of the SCR particle filter.

Figure 3:
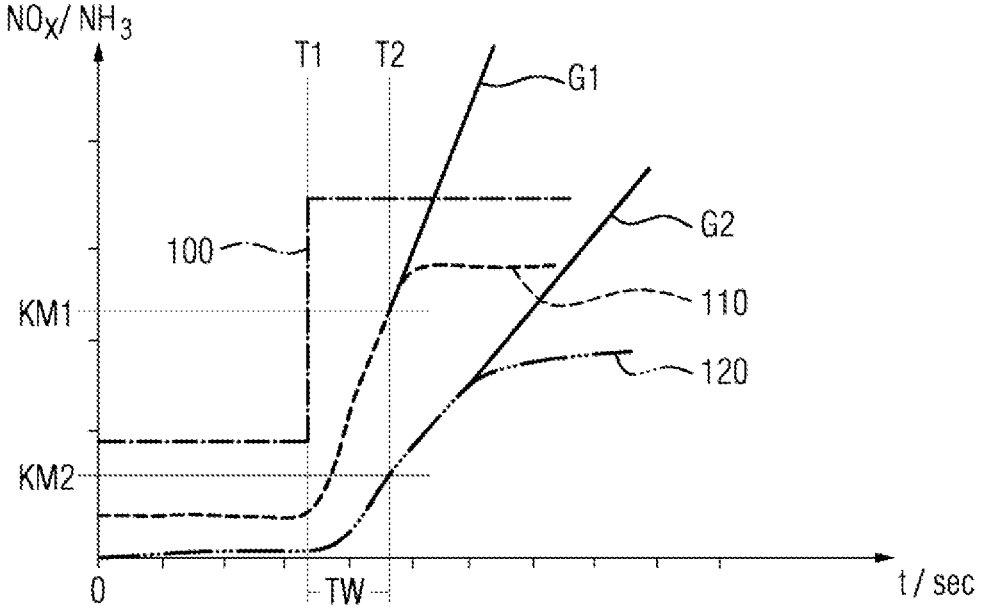
FIG. 3 is a qualitative illustration of curves of the $NO_X$/$NH_3$ concentration upstream and downstream of the SCR particle filter in the case of an intact and a defective SCR particle filter.

FIG. 3 shows an example of the courses of the $NO_X/NH_3$ concentration over time, which were recorded with the aid of combined $NO_X/NH_3$ concentration sensors upstream and downstream of the SCR particle filter. Here, the curve 100 shows the $NO_X/NH_3$ concentration upstream of the SCR particle filter, wherein, proceeding from an $NO_X/NH_3$ concentration, to which adjustment has been performed in the diagnostic operating mode, of approx. 40 ppm at the time T1, a defined concentration change by approx. 100 ppm to 140 ppm is induced. The curve 110 shows the $NO_X/NH_3$ concentration recorded downstream of the SCR particle filter in the case of a defective SCR particle filter. An elevated value of the $NO_X/NH_3$ concentration of approximately 15 ppm can already be seen here in the phase of the diagnostic operating mode. At time T1, the $NO_X/NH_3$ concentration begins to increase with a gradient G1 within the time window TW and increases to a maximum concentration KM1 at time T2, at the end of the time window TW.

By contrast, the curve 120 shows the $NO_X/NH_3$ concentration recorded downstream of the SCR particle filter in the case of an intact SCR particle filter. Here, a minimum value of the $NO_X/NH_3$ concentration is present in the phase of the diagnostic operating mode. In this case, too, at the time T1, the $NO_x/NH_3$ concentration begins to increase within the time window TW, but with a gradient G2 that is significantly shallower than that of the curve 110. Accordingly, up to the time T2, at the end of the time window TW, it is also the case that only a significantly lower maximum concentration KM2 is attained.

In some embodiments, as concentration comparison value VgW, use may be made of the respective maximum concentration MK1, MK2 attained up to a certain point in time within the time window TW or at the end of the time window TW, or also of the respective gradient G1, G2 of the $NO_X/NH_3$ concentration increase within the time window TW. Furthermore, some embodiments consider the concentration values determined downstream of the SCR particle filter and the concentration values specified or determined upstream in combination, and to determine a comparison value therefrom. Here, the $NO_X/NH_3$ concentration values upstream of the SCR particle filter may be based on the default values, determined using model considerations or measured by means of a concentration sensor (if present).

For the determination of a concentration comparison value VgW, it is possible for the gradient of the concentration increase downstream of the SCR particle filter determined within the time window TW to be divided by the step-change value of the concentration change upstream of the SCR particle filter. The result is used as concentration comparison value VgW. If, for example, the gradient of the concentration increase downstream of the SCR particle filter is 11.3 ppm/s and the step-change value of the concentration change upstream of the SCR particle filter is 480 ppm (wherein the signs must be observed), the result is a concentration comparison value of:

$$(11.3\ \text{ppm/s})/480\ \text{ppm}=0.024/\text{s}.$$

If a limit value GW of, for example, 0.016/s is present, this would be overshot (VgW≥GW), and the SCR particle filter would have to be evaluated as defective (SCR-PF=nok).

This approach increases the robustness of the method against disturbance influences.

In some embodiments, the $NH_3$ and/or $NO_X$ concentration change has a concentration increase and an immediately subsequent concentration reduction, and the values and/or the gradients of the concentration increase and of the concentration reduction in each case upstream and downstream of the SCR particle filter 3 are used in combination with one another for the evaluation of the measured $NH_3$ and/or $NO_X$ concentration change downstream of the SCR particle filter 3. For example, in each case one ratio of the gradient of the concentration increase downstream and the step-change value of the concentration increase upstream of the SCR particle filter and also of the gradient of the subsequent concentration decrease downstream and the associated step-change value of the concentration reduction upstream of the SCR particle filter can be formed, and their sum calculated.

Figure 4:
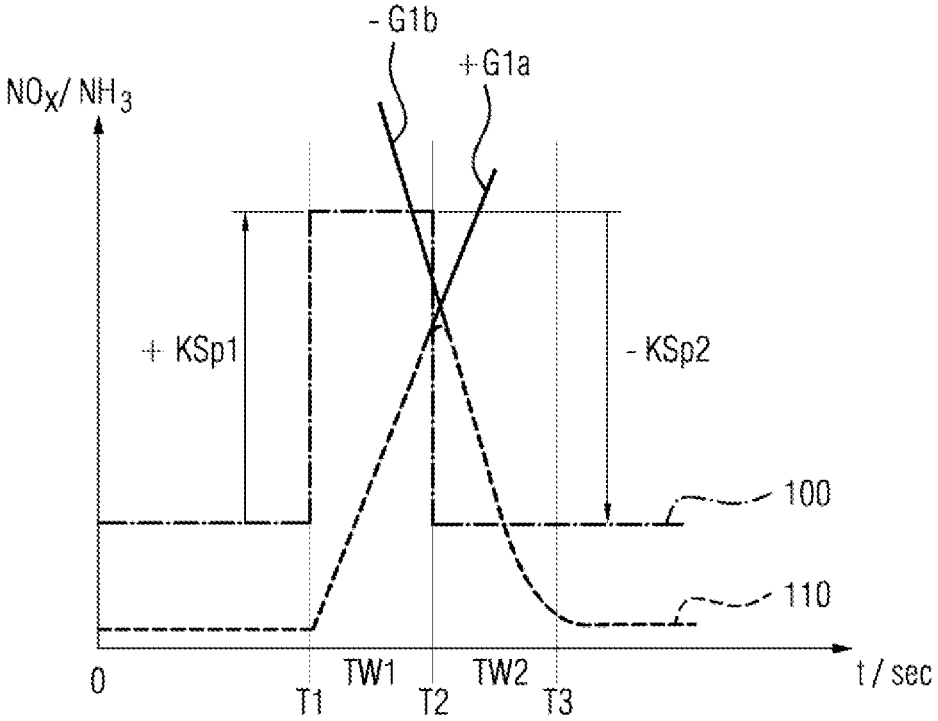
FIG. 4 is a qualitative illustration of curves of the $NO_X$/$NH_3$ concentration upstream and downstream of the SCR particle filter in the case of successive $NO_X$/$NH_3$ concentration changes.

This is illustrated qualitatively in FIG. 4. The figure shows the curve 100 of the $NH_3/NO_X$ concentration upstream and the resulting curve 110 of the $NH_3/NO_X$ concentration downstream of the SCR particle filter. The curve 100 shows a targetedly and definedly induced abrupt concentration increase +KSp1 by a certain amount at time T1, and a persistence of the increased $NH_3/NO_x$ concentration over the time window TW1 until the time T2. This is then followed by a likewise targetedly and definedly induced abrupt concentration reduction −KSp2 by the same amount, that is to say a complete withdrawal of the concentration increase, at time T2. The resulting course of the $NH_3/NO_X$ concentration downstream of the SCR particle filter shows an increase following the time T1 with the gradient +G1*a*, within the time window TW1 immediately following the concentration change +KSp1, until the time T2, and a subsequent drop in the $NH_3/NO_X$ concentration with a gradient −G1*b* within the time window TW2 immediately following the concentration change −KSp2, which time window lasts until the time T3. According to the above scheme, the concentration comparison value VgW can be determined according to the following relationship:

$$(+G1a/+KSp1)+(-G1b/-KSp2)=VgW$$

For example, if a gradient of +7.3 ppm/s downstream arises in the case of a step-change value of the concentration increase of +480 ppm upstream of the SCR particle filter, and subsequently a gradient of −11.3 ppm/s downstream arises in the case of a step-change value of the concentration reduction of −480 ppm/s, then the concentration comparison value is calculated as:

$$((+7.3\ \text{ppm/s})/+480\ \text{ppm})+((-11.3\ \text{ppm/s})/-480\ \text{ppm})=0.015/\text{s}+0.024/\text{s}=0.039/\text{s}.$$

If a limit value GW of, for example, 0.026/s is present, this would be overshot (VgW≥GW), and the SCR particle filter would have to be evaluated as defective (SCR-PF=nok). This approach further increases the robustness of the method against disturbance influences.

In some embodiments, if the targeted, defined $NH_3$ and/or $NO_x$ concentration change in the exhaust-gas mass flow 10 upstream of the SCR particle filter 3 is withdrawn after the diagnosis of the SCR particle filter 3, then the diagnostic operating mode is ended and the $NH_3$ and/or $NO_x$ concentration is again set or controlled in a manner dependent on the present operating point of the internal combustion engine. As can be seen from FIG. 2, various further measures can now be initiated on the basis of and in a manner dependent on the diagnostic result.

If the diagnosis yields that the SCR particle filter is intact and functioning correctly (SCR-PF=ok), then, after the execution of the method, that is to say after the diagnosis of the functionality of the SCR particle filter 3, the internal combustion engine can continue to be operated in the normal working operating mode again; this is illustrated in the method step denoted "BP_Norm".

However, if the diagnosis yields that the SCR particle filter is defective (SCR-PF=nok), then emergency operation of the internal combustion engine can instead be initiated, which for example still makes it possible, with reduced engine performance, to seek out a workshop. At the same time, a fault message can be output to the vehicle driver, prompting them to seek out the nearest workshop immediately and to have the repair carried out. This is illustrated in FIG. 2 in the method step denoted "BP_Not".

What is claimed is:

1. A method for operating an exhaust-gas aftertreatment system of an internal combustion engine, wherein the exhaust-gas aftertreatment system has an exhaust-gas line for conducting an exhaust-gas mass flow and an SCR particle filter with a filter substrate arranged in the exhaust-gas line, and a device for targeted, defined variation of the $NH_3$ and/or $NO_X$ concentration arranged in the exhaust-gas mass flow upstream of the SCR particle filter, and a first concentration sensor arranged in the exhaust-gas mass flow downstream of the SCR particle filter, the method comprising:

setting the internal combustion engine to a diagnostic operating mode, wherein certain relevant diagnostic operating parameters of the internal combustion engine are verified for, set, or adjusted to, correspondence with diagnostic default values;

inducing, in the presence of the diagnostic operating mode, a targeted, defined $NH_3$ concentration change and/or $NO_X$ concentration change in the exhaust-gas mass flow upstream of the SCR particle filter in relation to the values of the $NH_3$ concentration and/or of the $NO_X$ concentration present in the diagnostic operating mode;

measuring the $NH_3$ and/or $NO_X$ concentration change in the exhaust-gas mass flow downstream of the SCR particle filter within a specified time window directly following the $NH_3$ and/or $NO_X$ concentration change induced upstream of the SCR particle filter using the first concentration sensor generating a corresponding first concentration measurement signal;

providing a correlating concentration comparison value on the basis of the first concentration measurement signal;

evaluating the $NH_3$ and/or $NO_X$ concentration change downstream of the SCR particle filter on the basis of the respective concentration comparison value and predefined limit values; and diagnosing the SCR particle filter as defective due to apertures in the filter substrate if the evaluation yields that the concentration comparison value has overshot a predefined limit value for a ratio between the $NH_3$ and/or $NO_X$ concentration change downstream of the SCR particle filter and the $NH_3$ and/or $NO_X$ concentration change upstream of the SCR particle filter;

wherein the diagnostic operating mode is characterized by at least one of the following diagnostic operating parameters: engine speed of the internal combustion engine between 1100 and 1900 revolutions/minute; operating temperature of the SCR particle filter between 250° C. and 350° C.; and pressure difference of the exhaust-gas mass flow across the SCR particle filter between 3 bar and 7 bar.

2. The method as claimed in claim 1, wherein the device for targeted, defined inducement of the $NH_3$ and/or $NO_X$ concentration change in the exhaust-gas mass flow upstream of the SCR particle filter includes an $NH_3$ feed device for feeding an $NH_3$ solution into the exhaust-gas line and/or a first exhaust-gas recirculation device branching off from the exhaust-gas line upstream of the SCR particle filter and/or a further exhaust-gas recirculation device branching off from the exhaust-gas line downstream of the SCR particle filter.

3. The method as claimed in claim 1, wherein the diagnostic operating mode is further characterized by at least one of the following diagnostic operating parameters: stored $NH_3$ quantity in the SCR particle filter above a predefined threshold value; and added $NH_3$ quantity adjusted to a value which is stoichiometric in relation to the $NO_X$ concentration in the exhaust gas upstream of the SCR particle filter.

4. The method as claimed in claim 2, wherein the defined $NO_X$ concentration change upstream of the SCR particle filter consists of an increase or a reduction of $NO_X$ concentration set as a result of a defined reduction or increase of an exhaust-gas recirculation rate of the first exhaust-gas recirculation device and/or of the further exhaust-gas recirculation device.

5. The method as claimed in claim 2, wherein the defined $NH_3$ concentration change upstream of the SCR particle filter consists of a defined increase or reduction of the $NH_3$ concentration set as a result of a defined increase or reduction of the added quantity of the $NH_3$ solution by the $NH_3$ feed device.

6. The method as claimed in claim 1, wherein the evaluation of the $NO_X$ concentration change and/or $NH_3$ concentration change downstream of the particle filter measured within the specified time window includes using a respective maximum value or minimum value attained within the defined time window of the concentration change and/or a gradient of the concentration change as concentration comparison value.

7. The method as claimed in claim 1, further comprising providing, in the course of the $NH_3$ and/or $NO_X$ concentration change, a concentration increase and an immediately subsequent concentration reduction;

wherein, after the concentration increase for a particular first period of time, the concentration reduction occurs to such a selected value, and for such a selected second period of time, that a resulting mean value of the $NH_3$ and/or $NO_X$ concentration over the duration of the concentration increase and of the concentration reduction corresponds to the value of the $NH_3$ and/or $NO_X$ concentration prevailing before the concentration increase.

8. The method as claimed in claim 1, wherein the measurement of the $NH_3$ and/or $NO_X$ concentration change in the exhaust-gas mass flow, includes using a combined concentration sensor which combines the $NH_3$ and/or $NO_X$ concentration change in a combined concentration measurement signal.

9. The method as claimed in claim 1, wherein the respective specified time window has a duration of less than or equal to 5 seconds.

10. The method as claimed in claim 1, further comprising withdrawing, after the diagnosis of the SCR particle filter, the targeted, defined $NH_3$ and/or $NO_X$ concentration change in the exhaust-gas mass flow upstream of the SCR particle filter and, in a manner dependent on the diagnosis result, transferring the internal combustion engine back into the normal working operating mode and operating in a mode designated as emergency operation.

11. The method as claimed in claim 1, wherein:

an additional concentration sensor is arranged in the exhaust-gas mass flow upstream of the SCR particle filter;

the additional concentration sensor generates a second concentration measurement signal correlating with the $NH_3$ and/or $NO_X$ concentration change in the exhaust-gas mass flow upstream of the SCR particle filter;

the concentration comparison value used for the evaluation of the measured $NH_3$ and/or $NO_X$ concentration change downstream of the SCR particle filter is based on the respective $NH_3$ and/or $NO_X$ concentration changes downstream and upstream of the SCR particle filter determined within the defined time window.

12. The method as claimed in claim 11, wherein the values of the $NH_3$ and/or $NO_X$ concentration changes determined within the defined time window at a particular point in time, and/or the gradients of said concentration changes, in each case upstream and downstream of the SCR particle filter are compared with one another or set in relation to one another.

13. The method as claimed in claim 12, wherein the $NH_3$ and/or $NO_X$ concentration change has a concentration increase and an immediately subsequent concentration reduction, and the values and/or the gradients of the concentration increase and of the concentration reduction in each case upstream and downstream of the SCR particle filter are used in combination with one another for the evaluation of the measured $NH_3$ and/or $NO_X$ concentration change downstream of the SCR particle filter.

14. An exhaust-gas aftertreatment system of an internal combustion engine, the system comprising:

an SCR particle filter with a filter substrate arranged in an exhaust-gas line;

a device for targeted, defined variation of the $NH_3$ and/or $NO_X$ concentration in the exhaust-gas mass flow upstream of the SCR particle filter;

a first concentration sensor for measuring the $NH_3$ and/or $NO_X$ concentration in the exhaust-gas mass flow downstream of the SCR particle filter; and an electronic processing and control unit configured for targeted, defined variation of the $NH_3$ and/or $NO_X$ concentration in the exhaust-gas mass flow upstream of the SCR particle filter using the device for targeted, defined variation of the $NH_3$ and/or $NO_X$ concentration and for detecting a first concentration measurement signal output by the first concentration sensor;

wherein the electronic processing and control unit is configured to diagnose defects in the SCR particle filter caused by apertures in the filter substrate, the method comprising:

setting the internal combustion engine to a diagnostic operating mode, wherein certain relevant diagnostic operating parameters of the internal combustion engine are verified for, set, or adjusted to, correspondence with diagnostic default values;

inducing, in the presence of the diagnostic operating mode, a targeted, defined $NH_3$ concentration change and/or $NO_X$ concentration change in the exhaust-gas mass flow upstream of the SCR particle filter in relation to the values of the $NH_3$ concentration and/or of the $NO_X$ concentration present in the diagnostic operating mode;

measuring the $NH_3$ and/or $NO_X$ concentration change in the exhaust-gas mass flow downstream of the SCR particle filter within a specified time window directly following the $NH_3$ and/or $NO_X$ concentration change induced upstream of the SCR particle filter using the first concentration sensor generating a corresponding first concentration measurement signal;

providing a correlating concentration comparison value on the basis of the first concentration measurement signal;

evaluating the $NH_3$ and/or $NO_X$ concentration change downstream of the SCR particle filter on the basis of the respective concentration comparison value and predefined limit values; and diagnosing the SCR particle filter as defective if the evaluation yields that the concentration comparison value has overshot a predefined limit value for a ratio between the $NH_3$ and/or $NO_X$ concentration change downstream of the SCR particle filter and the $NH_3$ and/or $NO_X$ concentration change upstream of the SCR particle filter;

wherein the diagnostic operating mode is characterized by at least one of the following diagnostic operating parameters: engine speed of the internal combustion engine between 1100 and 1900 revolutions/minute; operating temperature of the SCR particle filter between 250° C. and 350° C.; and pressure difference of the exhaust-gas mass flow across the SCR particle filter between 3 bar and 7 bar.

15. The exhaust-gas aftertreatment system as claimed in claim 14, further comprising an additional concentration sensor arranged in the exhaust-gas mass flow upstream of the SCR particle filter measuring the $NH_3$ and/or $NO_X$ concentration upstream of the SCR particle filter.

16. The exhaust-gas aftertreatment system as claimed in claim 14, wherein the device for targeted, defined variation of the $NH_3$ and/or $NO_X$ concentration in the exhaust-gas mass flow upstream of the SCR particle filter includes an $NH_3$ feed device for the feed of an $NH_3$ solution into the exhaust-gas line and/or a first exhaust-gas recirculation device branching off from the exhaust-gas line upstream of the SCR particle filter and/or has a further exhaust-gas recirculation device branching off from the exhaust-gas line downstream of the SCR particle filter.

17. The exhaust-gas aftertreatment system as claimed in claim 14, wherein that the electronic processing and control unit comprises an integral constituent part of a central control unit of the internal combustion engine.

* * * * *